US006279791B1

(12) United States Patent
Betman et al.

(10) Patent No.: US 6,279,791 B1
(45) Date of Patent: Aug. 28, 2001

(54) DEVICE FOR FOLDING OF APPAREL

(75) Inventors: Zila Betman, 31 Harishonim St., Kiriat Haim 26302; Shimon Sigler, Kfar Vradim, both of (IL)

(73) Assignee: Zila Betman, Kiriat Haim (IL)

( * ) Notice: Subject to any disclaimer, the term of this patent is extended or adjusted under 35 U.S.C. 154(b) by 0 days.

(21) Appl. No.: 09/400,835

(22) Filed: Sep. 21, 1999

(30) Foreign Application Priority Data

Oct. 1, 1998 (IL) ..... 126429

(51) Int. Cl.[7] ..... A41H 33/00
(52) U.S. Cl. ..... 223/37; 223/38
(58) Field of Search ..... 223/37, 38, 87; 493/405, 451

(56) References Cited

U.S. PATENT DOCUMENTS

| | | | | |
|---|---|---|---|---|
| 1,657,551 | * | 1/1928 | Schremp | 223/37 |
| 2,508,579 | * | 5/1950 | McFall | 223/37 |
| 4,727,920 | * | 3/1988 | Siegler | 160/84 R |
| 5,011,052 | | 4/1991 | Craig | 223/37 |
| 5,154,329 | | 10/1992 | Dorfmueller | 223/37 |
| 5,174,479 | | 12/1992 | Dufour | 223/37 |

FOREIGN PATENT DOCUMENTS

| | | |
|---|---|---|
| 25 55 931 | 12/1975 | (DE) . |
| 27 49 818 | 5/1979 | (DE) . |
| 1 510 905 | 5/1978 | (GB) . |

* cited by examiner

*Primary Examiner*—Bibhu Mohanty
(74) *Attorney, Agent, or Firm*—Blank Rome Comisky & McCauley LLP

(57) ABSTRACT

A shirt having a longitudinally extending body with a front and a back, a collar at a top end of the body, sleeves projecting from sides of the body, and buttons on the front of the body, is folded by first orienting the shirt flat with the body and arms generally coplanar and then folding side parts of the body inward along longitudinal fold lines and folding the sleeves down to lie on the folded-in side parts. Then bottom part of the body is folded up against the back of the body along a transverse fold line such that a portion of the bottom part projects upward past the collar and some of the front buttons are positioned on the back of the folded-up bottom part. The projecting portion of the bottom part is then tucked between the folded-in side parts and the back of the body to impart to the shirt a generally rectangular shape. The back of the folded shirt is then overlain with a stiffener sheet of generally the same rectangular shape as the folded shirt and at least some of the buttons positioned on the back of the folded bottom part are fitted through the stiffener sheet to secure same in place.

11 Claims, 5 Drawing Sheets

DEVICE FOR FOLDING OF APPAREL

FIELD OF THE INVENTION

The present invention relates to devices for folding of apparel, e.g. man's or women's shirts, blouses, sweaters or similar garments. More particularly the present invention refers to a new idea how to fold apparel properly, how to package thereof and how to keep it in a wrinkle-free state so as to retain the nice appearance for a long period of time.

The invention allows to fold ironed garments in a very compact configuration suitable for storing in suitcases, small volume bags, small "James Bond" briefcases etc.

The apparel folded in accordance with the present invention can be hanged on a rack for clothes or on a bar and kept in a wrinkle-free shape ready for dressing without the necessity in additional treatment.

BACKGROUND OF THE INVENTION

Most of people and especially traveling businessmen or representatives prefer to dress their shirts when they have proper and nice appearance. Furthermore during traveling, official events or in other occasions people need fresh and nice ironed shirts. Normally people change and dress clean and ironed shirts very often due to dirt, food marks, water or rain drops, perspiration marks, dust etc. Normally there is no time and place to iron the shirt before dressing after it has been already taken out from the package.

Due to wrong or non-optimal packaging or pressure of other objects in the briefcase, suitcase, etc., the shirt becomes wrinkled, not straight, not flat and therefore it has improper appearance. Therefore people are looking for a method or way to pack and store their shirts in such a way that their appearance is not deteriorated by storing and it can be dressed without any additional preliminary treatment.

Another well known problem associated with shirts after they are folded and stored is the way of folding to optimal overall size, the positioning of sleeves in the folded condition and the most suitable way to iron collars and to keep them in proper shape.

Shirts are ironed flat and then folded afterwards. Ironing and folding can be done in accordance with various methods or steps and most of the people develop their own ideas and habits how to fold their garments.

When offered for sale the new shirts are supplied normally packed and folded with a sample flat piece of thick paper in the middle and a sheet of paper or plastics in the collar. This is a very simple shape and method for one time use. The papers are thrown away and not used anymore. They do not help during folding of shirts after ironing and have only limited function.

Shirts without ironing are hanged on the rack and not folded. The use of the present invention can solve the folding problem also in this case.

There are known various prior art devices for folding and storing of garments. In the U.S. Pat. No. 5,011,052 there is disclosed a folding device for apparel, which facilitates the folding of shirts or sweaters. The device consists of a flat base having plurality of creases to allow the operator to manipulate the shirt while folding thereof in various stages to achieve complete and proper folding. The creases are directed in horizontal, vertical and diagonal directions and the shirt should be folded along all of them, which render the device and use thereof somewhat complicate and unsuitable for folding the apparel into configuration suitable for storing in a small briefcase.

In the U.S. Pat. No. 5,154,329 and U.S. Pat. No. 5,174,479 there are described a configured shirt-shaper for folding shirts and a method for folding a shirt. The shaper is configured as a flat base member configured as a rectangular sheet with arm members extending from each upper corner area and a first and a second fold line extending longitudinally along one side and the other side to divide the base member into two substantially equal side sections and a mid-section. The shaper is provided only with longitudinal fold lines and its surface is not sufficient to fold the shirt also in transversal directions.

There are known also other shirt folding devices employing fold lines, however they always employ either solely longitudinal fold lines or in combination with the transversal fold lines and diagonal fold lines and none of them envisages a simple combination of longitudinal and transversal fold lines so as to fold the garment into compact configuration, which can be advantageously stored in folded wrinkle-free state which dimensions fit small briefcases usually used by traveling business people.

OBJECTS AND SUMMARY OF THE INVENTION

It is the main object of the present invention to provide a simple, cheap and convenient folding device suitable for fast and easy folding and storing of ironed apparel and to guarantee its wrinkle-free and nice shape.

The further object of the present invention is to provide a folding device which can be easily used by any person without the necessity for professional training or special skills.

Still further object of the invention is to provide a folding device suitable for folding apparel and storing thereof in compact folded configuration inside suitcases, briefcases, bags and other small volume places, while preserving their nice and wrinkle-free shape so as to dress them without the necessity in additional ironing. The device of the present invention enables storing of folded shirt within a briefcase together with other articles like folders, papers, books etc. since it can be folded in the proportional size.

The above and other objects of the present invention can be achieved in accordance with the following combination of its essential features referring to different embodiments thereof.

The first embodiment of the present invention refers to a device for folding of apparel, especially men's shirts and storing thereof in a wrinkle-free folded state, said device being configured as a flat base member having mutually perpendicular length dimension and width dimension, said dimensions corresponding to those of the men's shirt so as to fit inside the flattened shirt when buttoned, said base member being provided with a fold lines for folding thereof into compact configuration, said fold lines comprise a couple of parallel longitudinal fold lines extending along the length dimension of the base member and at least one transversal fold line extending along the width dimension of the base member, said longitudinal fold lines are situated on the base member to divide thereof into two equal lateral sections and a middle section situated therebetween, the width of said middle sections is dimensioned to accommodate at least the sum of widths of the lateral sections after the base member is folded along the longitudinal fold lines, the transversal fold lie is situated on the base member to enable folding thereof into compact configuration.

In accordance with the other embodiment said base member is made of a foldable rigid or semi-rigid material.

In still further embodiment said fold lines are marked on the surface of the base member.

In yet another embodiment said fold lines are scored or perforated.

According to the other embodiment said fold lines comprise creases.

As per still other embodiment said base member is made of cardboard or plastic material.

According to the further embodiment said base member is provided with a couple of parallel transversal fold lines extending along the width dimension of the base member to divide thereof into a top section, a bottom section and a middle section situated therebetween, the width of the middle section being more than the width of the bottom section.

In the further preferred embodiment the upper part of the base member is formed with lateral slopes, said slopes being configured to enable folding of shirt's sleeves along the slopes.

As per another preferred embodiment the upper part of the base member is formed with an opening to enable holding the base member and pulling thereof inside the flattened shirt.

And in still further embodiment the opening is located in the center of the upper part of the base member.

The present invention in its various embodiments has only been summarized briefly. For better understanding of the present invention as well of its benefits and advantages reference will now be made to the following description of its embodiments taken in combination with the accompanying drawings.

DETAILED DESCRIPTION OF THE PREFERRED EMBODIMENTS

Figure 1:
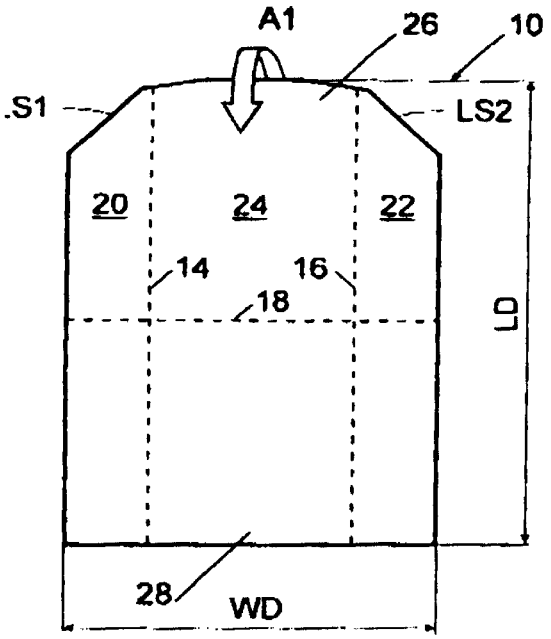
FIG. 1 shows the first embodiment of the present invention
Figure 6:
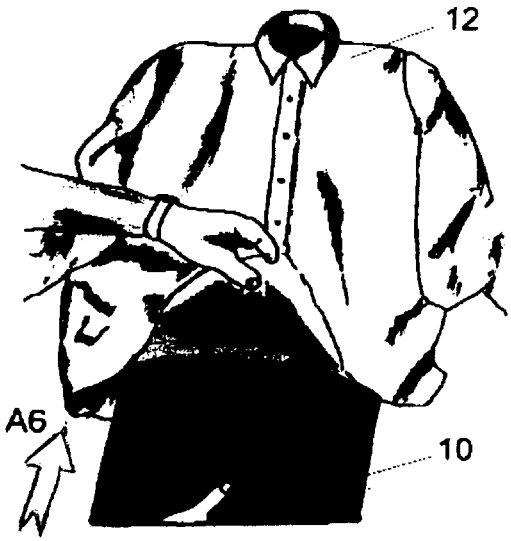
FIG. 6 shows how the folding device is inserted into the flattened and buttoned shirt

With reference to FIG. 1 there is shown the first embodiment of the folding device of the present invention, which comprises a flat base member 10, manufactured from a sheet of appropriate foldable material, e.g. cardboard, plastic, coated paper etc. The suitable material should retain its flat shape either in folded or unfolded condition and at the same time be pliable enough to enable easy folding. The flat member has substantially rectangular configuration, which height will be further referred to as a length dimension and its width will be referred to as a width dimension WD. The above dimensions define in general the configuration of the base member and are chosen to fit the dimensions of the men's shirt when it is flattened. By virtue of this provision the base member can be easily inserted within a buttoned shirt 12 as shown in FIG. 6 and folded therewith as it will be explained later. The upper part of the base member is formed with two lateral slopes LS1, LS2, which are configured to enable folding of shirt's sleeves along the slopes.

The base member is provided with a couple of parallel longitudinal fold lines 14, 16, which extend along the length dimension LD and with at least one transversal fold line 18 which extends along the width dimension WD. In the embodiment shown in FIG. 2 the base member is provided with two parallel transversal fold lines 18, 18'. The longitudinal fold lines divide the base member into two lateral sections 20, 22 and a mid-section 24, which is situated therebetween. The width of the mid-section measured along the dimension WD is slightly more than the sum of widths of the lateral sections. It can be easily appreciated that by virtue of this provision the mid-section accommodates the lateral sections and they can be easily folded-in along the longitudinal fold lines. In practice the width of the mid-section is 31 cm and the width of each lateral section is about 13 cm (for a medium size shirt). The transversal fold line 18 divides the base member into an upper section 26 and a lower section 28. It is advantageous if this fold line divides the base member into unequal sections in terms of their widths measured along the LD dimension. In particular the width of the upper section should slightly exceed the width of the lower section. In practice the width of the upper section is 41 cm and the width of the lower section is about 38 cm (for a medium size shirt).

Figure 2:
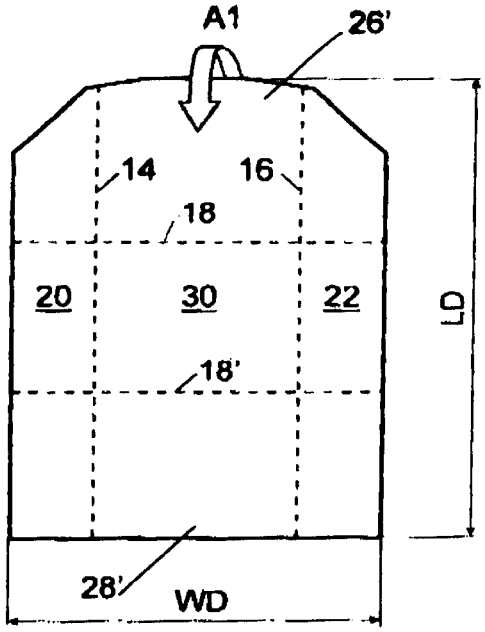
FIG. 2 shows the second embodiment of the present invention

In the embodiment shown in FIG. 2 the base member is provided with a couple of parallel transversal fold lines 18, 18', which divide the base member into an upper part 26', a lower part 28' and situated therebetween a middle part 30. The measured along the dimension LD width of the middle part is more than the width of the lower section 28. In practice the width of the upper section is about 28 cm the width of the middle section is about 26 cm and the width of the lower section is about 25 cm (for a medium size shirt).

Figure 4:
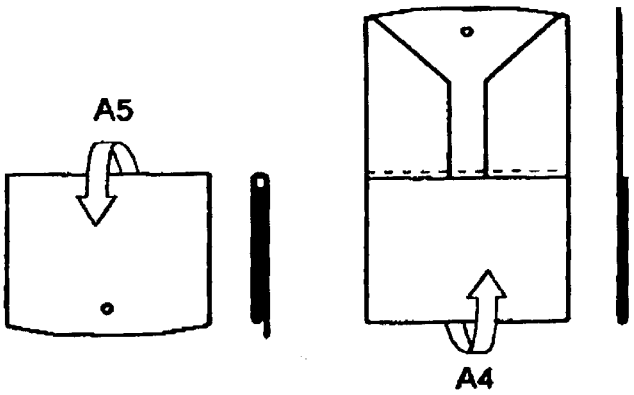
FIG. 4 shows how the folding device of the present invention is folded along the transversal fold lines
Figure 3:
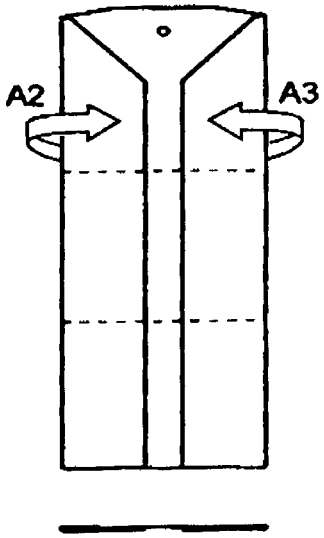
FIG. 3 shows how the folding device of the present invention is folded along the longitudinal fold lines.
Figure 5:
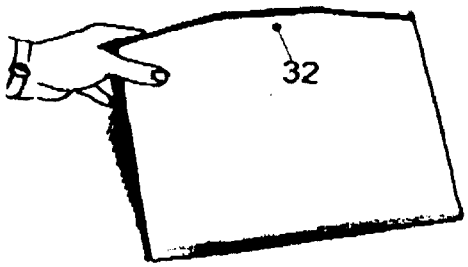
FIG. 5 shows the folding device of the present invention after it is folded into compact configuration

By virtue of the longitudinal and transversal fold lines the base member can be folded as shown schematically by arrows A1 (see FIGS. 1,2), A2, A3 (see FIG. 3) and A4, A5 (see FIG. 4) thus gradually brought into compact configuration as shown in FIG. 5. The fold lines can be simply marked on the surface of the base member or formed as scores, perforations, creases etc. In practice it is very convenient if the base member is made of cardboard and coated by polypropylene.

Now with reference to FIGS. 6–12 it will be shown how the folding device of the present invention can be used for folding a garment into compact configuration and for storing thereof in a wrinkle-free state.

Figure 7:
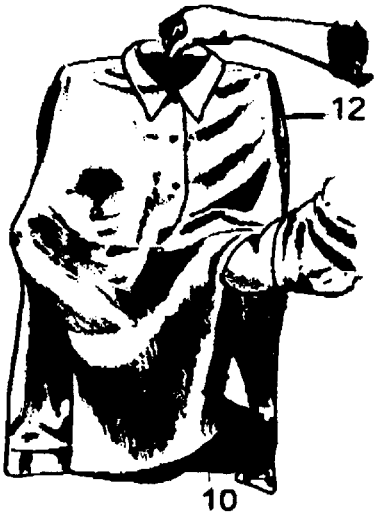
FIG. 7 shows how the folding device is manually held and pulled within the shirt
Figure 8:
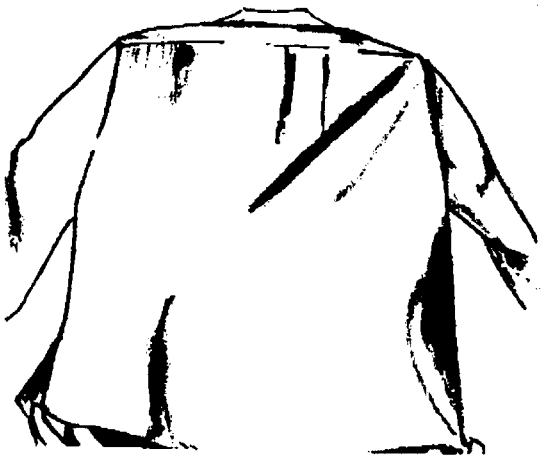
FIG. 8 shows how the lateral section of the folding device are opened so as to flatten the device within the shirt
Figure 9:
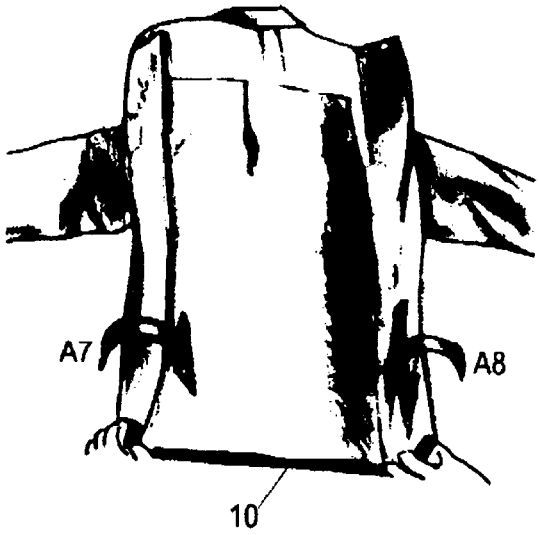
FIG. 9 shows folding of lateral sections together with the shirt along longitudinal fold lines
Figure 10:
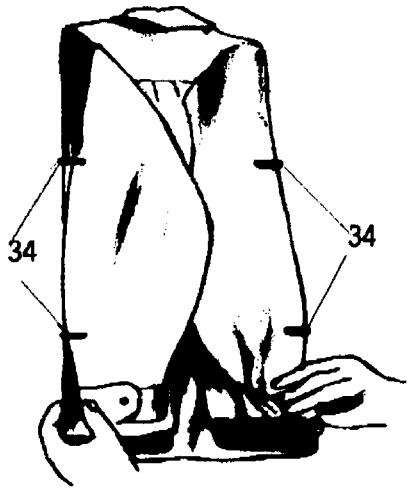
FIG. 10 shows folding of sleeves and fixation the longitudinally folded shirt by clips.

The base member is folded along the longitudinal fold lines so as to reduce its width along the WD dimension. The ironed garment, for example a men's shirt is flattened and buttoned and then the base member with folded-in lateral sections is put inside the shirt from below and pushed towards the shirt's collar by one hand as shown by an arrow A6 in FIG. 6. The base member is pushed up until the upper part thereof can be gripped by the other hand as shown in FIG. 7. It is advantageous if the base member is formed with an opening 32 situated in the middle of the upper part thereof. This opening helps to align the center line of the shirt with the middle of the base member and thus to ensure that the shirt extends symmetrically along the whole surface of the base member. The opening can be also used for more convenient gripping the base member. Now the folded-in lateral sections of the base member are unfolded and the base member extends along the whole surface of the shirt's rear side. The lateral sections of the base member are folded-in along the longitudinal fold lines together with the lying thereon shirt as shown by arrows A7, A8 in FIG. 9. The sleeves are folded down along the opposite lateral slopes LS1, LS2 to lie on the folded-in lateral sections of the base member. The projecting portions of the shirt are tucked to impart the shirt the configuration fitting the configuration of the base member and the shirt is fixed thereon by clips 34 as seen in FIG. 10.

Figure 11:
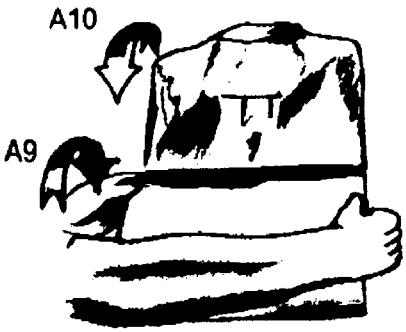
FIG. 11 shows folding the bottom part of the device together with the shirt along transversal fold line FIGS. 12*a, b* show the shirt after it is folded together with the folding device into compact configuration and an envelope suitable for storing inside the folded shirt.
Figure 12:
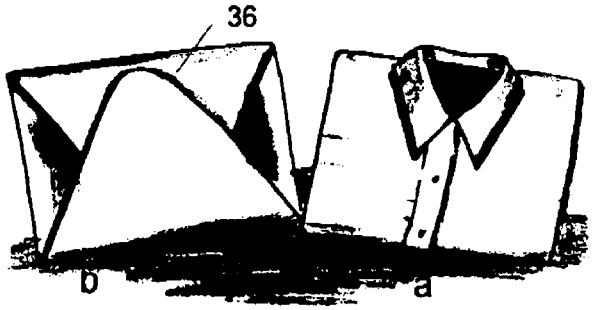

Now with reference to FIG. 11 the remaining part of the base member is folded along the transversal fold lines together with the shirt lying thereon. It is seen how the lower section of the base member presented in FIG. 2 is folded along the transversal fold line in the direction of a low arrow A9 and then the upper part of the base member is folded in the direction of an upper arrow A10. It is advantageous if the width of the middle section is somewhat less than the width of the upper section. By virtue of this provision the collar of the shirt can protrude beyond the base member after it is folded and thus to ensure that it will not be crumpled during the folding along the transversal fold lines.

The folded shirt is shown in FIG. 12*a* and it can be easily appreciated that by means of the folding device of the present invention it is brought into very compact configuration and at the same time its nice appearance and wrinkle-free state is fully preserved.

Figure 13:
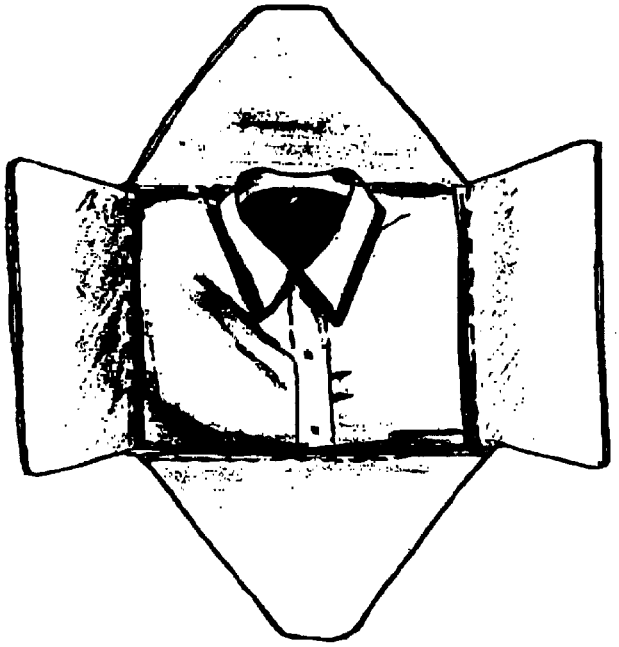
FIG. 13 shows folded shirt stored within the envelope
Figure 14:
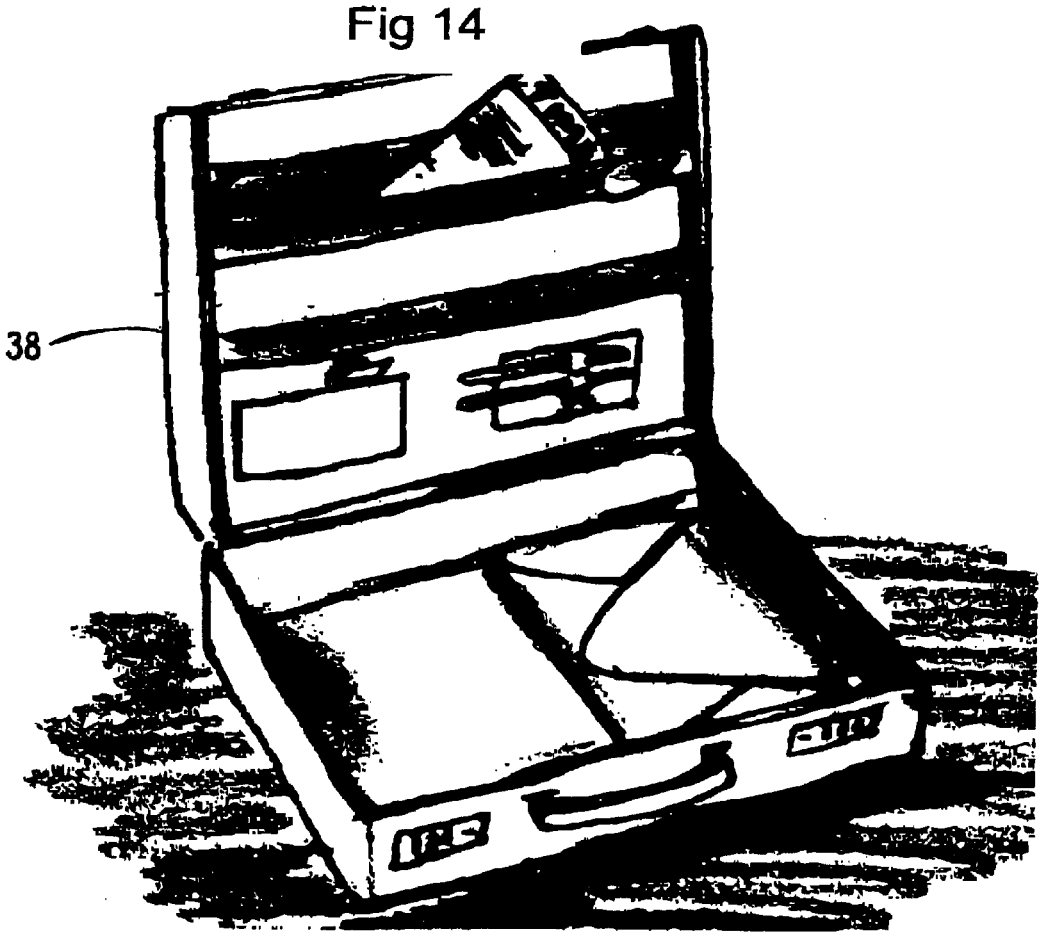
FIG. 14 shows the envelope with folded shirt stored in a briefcase

In order to prevent the occasion that the folded shirt gets dirty it can be conveniently put inside a cover or an envelope 36 as shown in FIG. 12*b*. In practice the envelope can be made of nylon or other suitable playable material. The envelope with the folded shirt inside is presented in FIG. 13 and it can be for example put within a briefcase 38 as presented in FIG. 14. Since the dimensions of the envelope fit the interior of the briefcase it can be stored inside the briefcase without the danger that the shirt becomes crumpled by the other articles present in the briefcase.

It might be also advantageous if the envelope is provided with a dedicated clip (not shown) for holding the shirt's collar to fix the shirt on the base member after it is folded.

It will be appreciated that the present invention is not limited to the above-described embodiments and that changes and modifications can be made by one ordinarily skilled in the art without deviation from the scope of the invention as will be defined below in the appended claims.

Figure 15A:
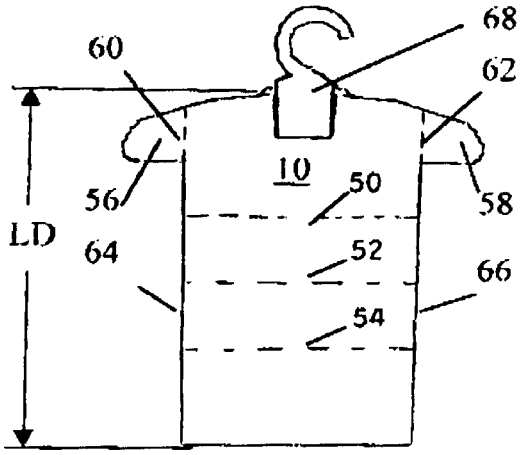
FIGS. 15*a,b,c,d* show additional embodiment of the present invention
Figure 15D:
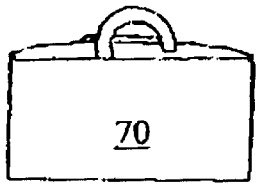
Figure 15B:
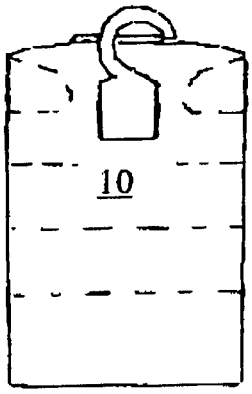
Figure 15C:
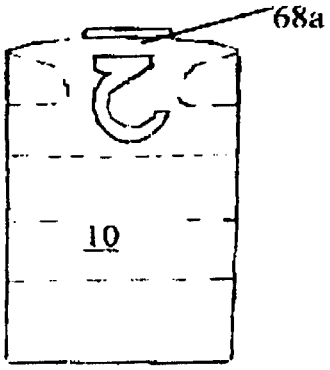

For example in an additional embodiment shown in FIG. 15*a* the folding device comprises flat base member 10 made with three transversal folding lines 50, 52, 54. The upper part of the base member is formed with two relatively short arm members 56, 58 extending laterally from each side of the base member. The arm members are dimensioned to accommodate a sleeve of the shirt by extending thereinto when the shirt is being put on the folding device. The arm members are foldable along respective longitudinal fold lines 60, 62 which are aligned with the corresponding lateral sides 64, 66 of the base member and extend along the length dimension LD of the base member. It can be seen that this embodiment is similar to previous embodiment since it also consists of two similar lateral sections and situated therebetween middle section. The width of the middle section exceeds the sum of widths of lateral sections so as to enable folding the arm members along the fold lines. In the present embodiment the upper part of the base member also can be made with a collar 68 which can be pushed down or hidden within the base member as shown in FIG. 15*b* or with a foldable hook 68*a* cut in the base member as shown in FIG. 15*c*. After the shirt is put on the base member and the arm members are folded-in along the longitudinal fold lines the rest of the base member is folded-in along the transversal lines to bring the whole device with the shirt into compact configuration. With reference to FIG. 15*d* it is shown how folded device is stored within the relatively small envelope 70. It can be appreciated however that the base member should not necessarily be folded along all three transversal fold line if it can be brought in compact configuration by folding-in along one or two fold lines.

The features disclosed in the foregoing description, and/or in the following claims, and/or in the accompanying drawings may, both separately and in any combination thereof, be material for realizing the present invention in diverse forms thereof.

We claim:

1. A device for folding of shirts and storing the shirts in a wrinkle-free folded state, said device comprising a flat base member defined by mutually perpendicular and substantially straight edges, the edges defining respectively a length dimension and width dimension of the base member, said dimensions corresponding to those of the shirt so as to fit inside the flattened shirt when the shirt is buttoned, said base member including fold lines for folding into a compact configuration, said fold lines comprising exactly two longitudinal fold lines extending parallel to one of the straight edges along the length dimension of the base member and at least one transversal fold line extending parallel to another one of the straight edges along the width dimension of the base member, said longitudinal fold lines dividing the device into two equal lateral sections and a middle section situated therebetween, a width of said middle section being dimensioned to accommodate a sum of widths of the lateral sections after the base member is folded along the longitudinal fold lines and said at least one transversal fold line being situated on the base member to enable folding thereof into the compact configuration.

2. The device as defined in claim 1, in which said base member is made of a foldable rigid or semi-rigid material.

3. The device as defined in claim 2, in which said fold lines are marked on the surface of the base member.

4. The device as defined in claim 2, in which said fold lines are scored or perforated.

5. The device as defined in claim 2, in which said fold lines comprise creases.

6. The device as defined in claim 2, in which said base member is made of corrugated cardboard, plastic or their combination.

7. The device as defined in claim 2 in which said base member is provided with a couple of transversal fold lines extending parallel to the width dimension of the base member to divide thereof into a top section, a bottom section and a middle section situated therebetween, the width of the middle section being less than the width of the top section or the bottom section.

8. The device as defined in claim 2, in which the upper part of the base member is formed with lateral slopes, said slopes being configured to enable folding of shirt's sleeves along the slopes.

9. A device for folding of shirts and storing the shirts in a wrinkle-free folded state, said device being configured as a rectangular and comprising a flat base member defined by mutually perpendicular length dimension and width dimension of the base member, said dimensions corresponding to those of the shirt so as to fit inside the flattened shirt when the shirt is buttoned, said base member being provided with fold lines for folding thereof into a compact configuration, said fold lines comprising a couple of longitudinal fold lines extending parallel to the length dimension of the base member and at least one transversal fold line extending parallel to the width dimension of the base member, said longitudinal fold lines dividing the device into two equal lateral sections and a middle section situated therebetween, a width of said middle section being dimensioned to accommodate a sum of widths of the lateral sections after the base member is folded along the longitudinal fold lines and said at least one transversal fold line being situated on the base member to enable folding thereof into the compact configuration;

in which the upper part of the base member includes two opposite side arm members extending laterally from each side of the base member, said arm members being dimensioned to accommodate a sleeve of the shirt by extending thereinto when the shirt is being put on the folding device, said arm members being foldable along the longitudinal fold lines, said longitudinal fold lines are aligned with respective sides of the base member and said base member includes three transverse fold lines for folding thereof into the compact configuration.

10. The device as defined in claim 2, in which the upper part of the base member is formed with an opening to enable holding the base member and pulling thereof inside the flattened shirt.

11. A device for folding of shirts and storing the shirts in a wrinkle-free folded state, said device comprising:

a flat base member defined by mutually perpendicular and substantially straight edges, the edges defining respectively a length dimension and width dimension of the base member, said dimensions corresponding to those of the shirt so as to fit inside the flattened shirt when the shirt is buttoned;

said base member including fold lines for folding into a compact configuration, said fold lines comprising exactly two parallel longitudinal fold lines extending generally parallel to one of the straight edges along the length dimension of the base member and at least one transversal fold line extending parallel to another one of the straight edges along the width dimension of the base member;

said longitudinal fold lines being situated on the base member to divide the base member into two equal lateral sections and a middle section situated therebetween, a width of said middle section being dimensioned to accommodate a sum of widths of the lateral sections after the base member is folded along the longitudinal fold lines;

the transversal fold line being situated on the base member to enable folding thereof into the compact configuration;

in which an upper part of the base member comprises lateral slopes, said slopes being configured to enable folding of sleeves of the shirt along the slopes.

* * * * *